US008221157B2

(12) United States Patent
Zantout

(10) Patent No.: US 8,221,157 B2
(45) Date of Patent: Jul. 17, 2012

(54) CONNECTOR ASSEMBLIES WITH INTEGRATED WIRING DIAGRAMS AND METHODS OF USING THE SAME

(75) Inventor: Alan E. Zantout, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 12/883,749

(22) Filed: Sep. 16, 2010

(65) Prior Publication Data

US 2011/0070768 A1 Mar. 24, 2011

Related U.S. Application Data

(60) Provisional application No. 61/244,317, filed on Sep. 21, 2009.

(51) Int. Cl.
*H01R 3/00* (2006.01)

(52) U.S. Cl. ..... 439/491

(58) Field of Classification Search ..... 439/491, 439/676, 488–490, 916
See application file for complete search history.

(56) References Cited

U.S. PATENT DOCUMENTS

| | | | | |
|---|---|---|---|---|
| 2,681,971 | A * | 6/1954 | Strickland, Jr. et al. | 219/632 |
| 3,240,915 | A * | 3/1966 | Carter et al. | 392/411 |
| 3,989,338 | A | 11/1976 | Gosser | |
| 4,401,035 | A * | 8/1983 | Spigarelli et al. | 105/61 |
| 4,820,193 | A | 4/1989 | Noorily | |
| 4,831,726 | A | 5/1989 | Moly | |
| 5,313,372 | A * | 5/1994 | Chabert et al. | 361/823 |
| 5,535,968 | A * | 7/1996 | Mokkapati et al. | 246/3 |
| 5,775,935 | A | 7/1998 | Barna | |
| 5,850,416 | A * | 12/1998 | Myer | 375/221 |
| 5,902,155 | A | 5/1999 | Polgar et al. | |
| 5,922,034 | A * | 7/1999 | Feely | 701/19 |
| 6,259,978 | B1 * | 7/2001 | Feely | 701/19 |
| 6,361,355 | B1 | 3/2002 | Matsuoka et al. | |
| 6,461,189 | B1 | 10/2002 | Koh | |
| 6,538,405 | B1 * | 3/2003 | Brzozowski et al. | 318/280 |
| 6,916,211 | B2 | 7/2005 | Price | |
| 7,081,010 | B2 | 7/2006 | Gorman | |
| 7,270,565 | B2 | 9/2007 | Kamata et al. | |
| 7,410,386 | B2 | 8/2008 | Fabian et al. | |
| 7,530,821 | B2 | 5/2009 | Miyake | |
| 7,547,227 | B1 | 6/2009 | Gibson et al. | |
| 7,585,191 | B2 * | 9/2009 | Hawley et al. | 439/676 |
| 7,938,676 | B1 * | 5/2011 | Patel et al. | 439/489 |
| 2006/0062035 | A1 * | 3/2006 | Cutler | 363/144 |
| 2010/0292877 | A1 * | 11/2010 | Lee | 701/21 |

FOREIGN PATENT DOCUMENTS

JP 405178333 * 7/1993

* cited by examiner

*Primary Examiner* — Jean F Duverne
(74) *Attorney, Agent, or Firm* — Cook Alex Ltd.

(57) ABSTRACT

Disclosed are connector assemblies having an integrated wiring diagram or being in conjunction with a tool having an integrated wiring diagram, and methods of using such connector assemblies or tools. The connector assemblies include wire entry ports for insertion of respective wires depicted on the wiring diagram. The connector assemblies have at least one housing having a wiring diagram on the at least one housing, on a receptacle that holds the at least one housing or on a tool that temporarily holds the at least one housing.

18 Claims, 12 Drawing Sheets

CONNECTOR ASSEMBLIES WITH INTEGRATED WIRING DIAGRAMS AND METHODS OF USING THE SAME

CROSS-REFERENCE TO RELATED APPLICATION

This application claims the benefit of U.S. Provisional Patent Application Ser. No. 61/244,317, filed Sep. 21, 2009, the disclosure of which is hereby incorporated by reference in its entirety.

BACKGROUND OF THE INVENTION

This disclosure relates generally to connecting elements for use in completing electrical circuits and methods of using the connecting elements in connector assemblies having an integrated wiring diagram or in conjunction with a tool having an integrated wiring diagram, and methods of using such connector assemblies or tools. The combination of the connectors and wiring diagram provide a convenient and safe way to permit an individual to replace circuit elements. In some instances, the elements affected during the use of the disclosed subject matter may be separated by a disconnect that incorporates a plug and socket combination to facilitate a safe way to replace circuit elements in live circuits.

A possible, but by no means exclusive, application for the connector assemblies with integrated wiring diagrams or for use in conjunction with tools having integrated wiring diagrams is presented with respect to fluorescent light fixtures. Such fixtures require a ballast to operate. Ballasts are typically hard-wired between the power supply and the fluorescent tube holders, although as previously mentioned a disconnect may have been installed to permit disconnection from the power supply when a ballast fails and is in need of replacement. Ballasts may be changed for reasons other than failure of an existing ballast. For example, older style magnetic ballasts may be replaced by a more recent electronic ballast. Ballast replacement traditionally has been performed by an electrician who cuts the wires to and removes the old ballast. The electrician then would install a new ballast, strip the wire ends, and connect the wires from the new ballast to the power supply and to the tube holders using suitable twist-on connectors such as those sold by IDEAL Industries, Inc. under their trademarks WIRE-NUT® and TWISTER®. Often this is done in offices, factories, commercial, retail spaces or other facilities where shutting down the power to the fixture is not a practical option.

In instances where a disconnect has been installed, the disconnect can be unplugged while connection of the wires is being accomplished and without being endangered by a live circuit. With respect to the replacement of a magnetic ballast with an electronic ballast, the ballast components and their associated wiring are not merely swapped one-for-one within the circuit. Indeed, the wiring must be altered and in a manner that may be considered counter-intuitive to even a licensed electrician. However, when the circuit is brought back on line with the reconnection to the live power supply, there is no room for error on the part of an electrician.

This scenario presents but one instance where there exists a need for a connector assembly to accomplish the rewiring, and which may be significantly enhanced by the placement of a wiring diagram on or adjacent the connector assembly. Unfortunately, electricians are not the only individuals who may install new or replacement components within a circuit, and it is believed that it would be beneficial in other instances to have a connector assembly in conjunction with a wiring diagram on the connector assembly or on a tool for use during installation of the connector assembly. The technology used should be familiar to factory personnel as well as electricians, with no special tools required by either. The connector assemblies should work with either solid or stranded wire and should attempt to minimize the costs for such an installation. The wiring diagram should remove the need for making judgments as to the proper wire placements, to minimize potential hazards.

SUMMARY

In a first aspect, the present disclosure includes a connector assembly having an integrated wiring or circuit diagram. The connector assembly includes at least one housing and at least one face having a plurality of wire entry ports. The wiring or circuit diagram is located on the connector assembly and has wire indicia displayed in association with respective wire entry ports of the at least one face of the connector assembly. The wire entry ports are configured to receive at least one inserted wire. The connector assembly having an integrated wiring diagram can be used to facilitate appropriate wiring of any electrical circuit involving at least one connector housing and where quick and convenient connections are desirable. It is particularly suited for use in circumstances where the wiring of the circuit is being changed due to introduction of a different component, such as is described herein with respect to fluorescent light fixture ballasts and the replacement of a magnetic ballast with an electronic ballast, although it could be used in a wide variety of other applications involving new installations or replacement operations as well.

In a second aspect, the disclosure provides a tool for use with a connector assembly and having an integrated wiring diagram. The tool includes a receptacle configured to temporarily receive a connector assembly, where the connector assembly further includes at least one wire connector housing, with the at least one wire connector housing having at least one face and a plurality of wire entry ports in the at least one face, and a wiring diagram located on the receptacle and having wire indicia located in correspondence to positions of the respective plurality of wire entry ports of the at least one wire connector housing.

In a third aspect, the disclosure provides a label for a connector assembly. The label has a front panel including at least a portion of a wiring diagram having wire indicia displayed on the front surface of the front panel and the wire indicia is associated with respective wire entry ports of a connector assembly. The front surface of the front panel is opposite a rear surface of the front panel which is to be disposed in a planar orientation with respect to a front of the connector assembly. The label also has at least one aperture associated with the wire indicia and through which conductive ends of wires may be inserted.

In a fourth aspect, the disclosure provides a method of manufacturing a connector assembly having an integrated wiring diagram. The method of manufacturing includes the steps of providing a connector assembly having a plurality of wire entry ports, providing a label that includes at least a portion of a wiring diagram having wire indicia displayed in association with the intended location of the respective wire entry ports of the connector assembly, and attaching the label to the connector assembly wherein the wire indicia is located in association with the respective wire entry ports of the connector assembly.

It will be appreciate that the connector assembly may include one or more housings, with each housing including at least two conductive connecting elements or conductive contacts, and the contacts being in electrically independent sets of two or more contacts where the contacts in each set are connected to each other. However, it will be appreciated that the number of contacts within each set may be dependent on the particular application in which the connector assembly will be used. Some applications may require only two sets of contacts which may be located in one or more housings. Other applications, such as the ballast rewiring described herein may require more than two sets of contacts and more than two contacts in a set. In any event, the disclosure herein does not depend at all on the housing construction or the contact design other than that the contacts must be able to receive an inserted conductor, such as the conductive portion of the stripped end of a wire. The wires being received may extend from any one of a number of devices, from a power supply, to a lamp unit, to a ballast, to another connector, or from any other electrical component.

DETAILED DESCRIPTION

Although the following discloses example connector assemblies with integrated wiring diagrams and tools with integrated wiring diagrams for completing connector assemblies, it will be appreciated that the teachings of this disclosure are in no way limited to such specific embodiments. On the contrary, it is contemplated that the teachings of this disclosure may be implemented in alternative configurations and environments, for use with alternative circuits and/or wire connectors. Thus, the methods, apparatus, and/or articles of manufacture disclosed herein may be advantageously adapted to enhance or improve new or replacement wiring installations, but are simply examples and not the only ways contemplated within the scope of the attached claims.

Figure 1:
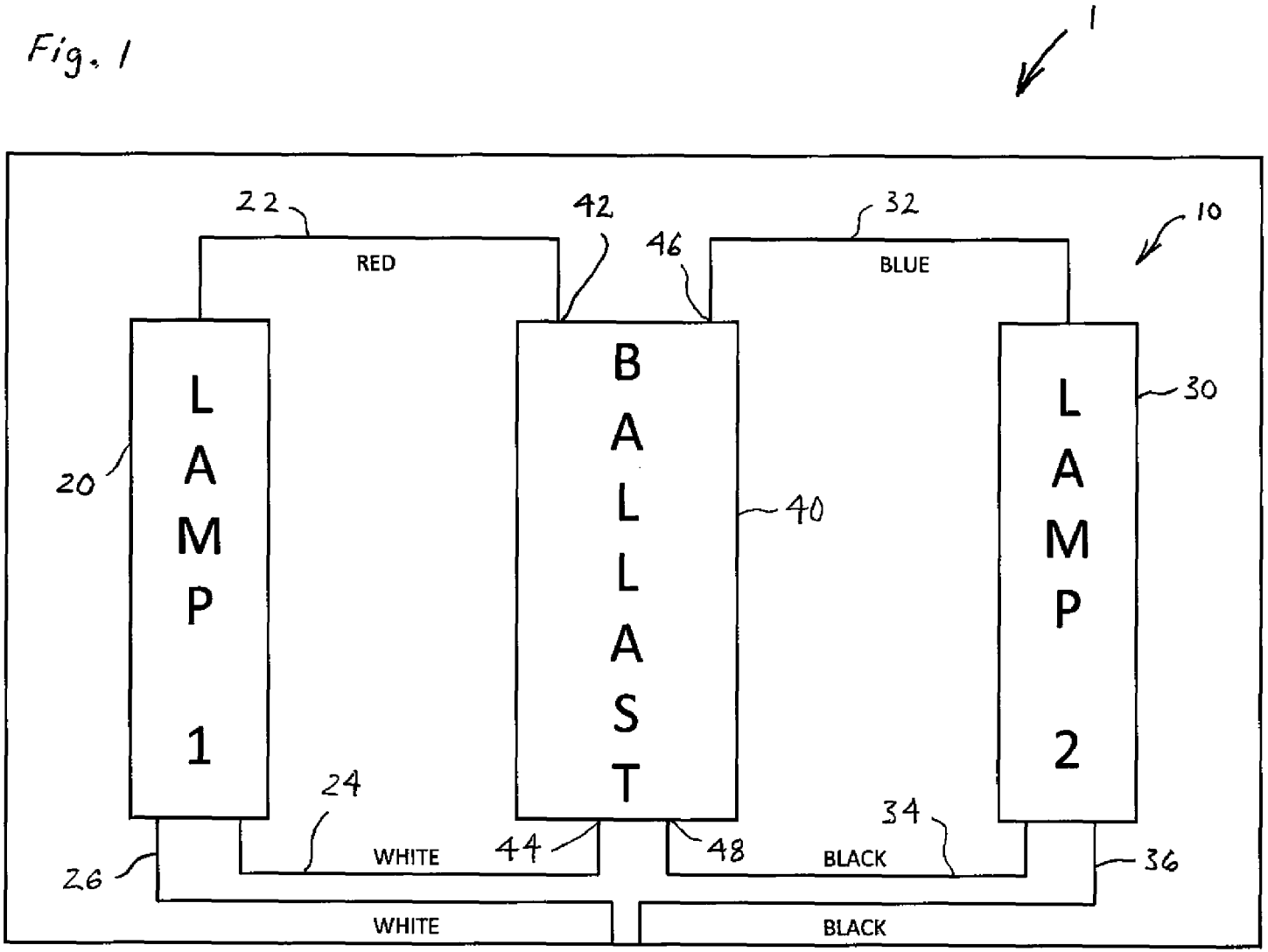
FIG. 1 is a wiring diagram for a circuit of a lighting system having a magnet ballast and two lamps.

Turning to the drawings, FIG. 1 illustrates a simplified version of a wiring diagram 1 for a circuit that includes electronic components for a lighting system 10. The lighting system 10 includes as its major components a first lamp 20, a second lamp 30 and a magnetic ballast 40. The lighting system 10 further includes a red wire 22 extending from the first lamp 20 to a first electrical connecting position 42 on the magnetic ballast 40, a first white wire 24 extending from the first lamp 20 to a second electrical connecting position 44 on the magnetic ballast 40, and a second white wire 26 extending from the first lamp 20 to a power supply for the circuit (not shown). The lighting system 10 also includes a blue wire 32 extending from the second lamp 30 to a third electrical connecting position 46 on the magnetic ballast 40, a first black wire 34 extending from the second lamp 30 to a fourth electrical connecting position 48 on the magnetic ballast 40, and a second black wire 36 extending from the second lamp 30 to a power supply for the circuit. The wiring diagram is simplified and is an example for illustration purposes only and it will be appreciated, for instance, that the color of the particular wires could be different and the ground is not shown.

When an individual, such as but not limited to an electrician, would attempt to remove and replace the magnetic ballast in the lighting system 10, shown in FIG. 1, with an electronic ballast, whether it be due to failure of the magnetic ballast or to otherwise upgrade the equipment, the individual would be faced with a situation that would require counter-intuitive rewiring of the circuit. Thus, rather than simply swapping a component, one-for-one, the individual would find that this job requires reconnecting the wires of the circuit in an unusual way. This unusual rewiring is illustrated in FIG. 2 in the wiring diagram 101.

FIGS. 2-5 illustrate a first example of a connector assembly with an integrated wiring diagram 100. In this particular example, a first wire connector 60, second wire connector 70 and third wire connector 80 are combined with a front panel 102 to form the connector assembly with an integrated wiring diagram 100. In this example, the three push-in wire connectors 60, 70 and 80, such as are sold by IDEAL Industries, Inc., have respective housings 60', 70' and 80' and are held together to form a connector assembly 104 by bonding to their respective front faces 60", 70" and 80" to a rear surface 106 of a front panel 102, which in this example is in the form of a relatively stiff label having adhesive on the rear surface 106 and a wiring diagram 101 located on the front surface 108. It will be appreciated that there are many alternatives that could be presented, having any number of wire connectors formed in any number of housings, with any number of respective wire entry ports having conductive connecting elements, also referred to herein as conductive contacts, within each connector, and alternative methods of combining the conductive connecting elements or conductive contacts into a connector assembly, as well as alternative methods of combining a wiring diagram with the connector assembly. While in this example a connector assembly 104 is formed by a two-port wire connector 60, a five-port wire connector 70 and a two-port wire connector 80, all being held together by a front panel 102 that bears a wiring diagram 101, several other examples will be provided within this description of the embodiments. It also should be understood that this description is provided for illustration of some examples and is not intended to limit the attached claims.

Figure 2:
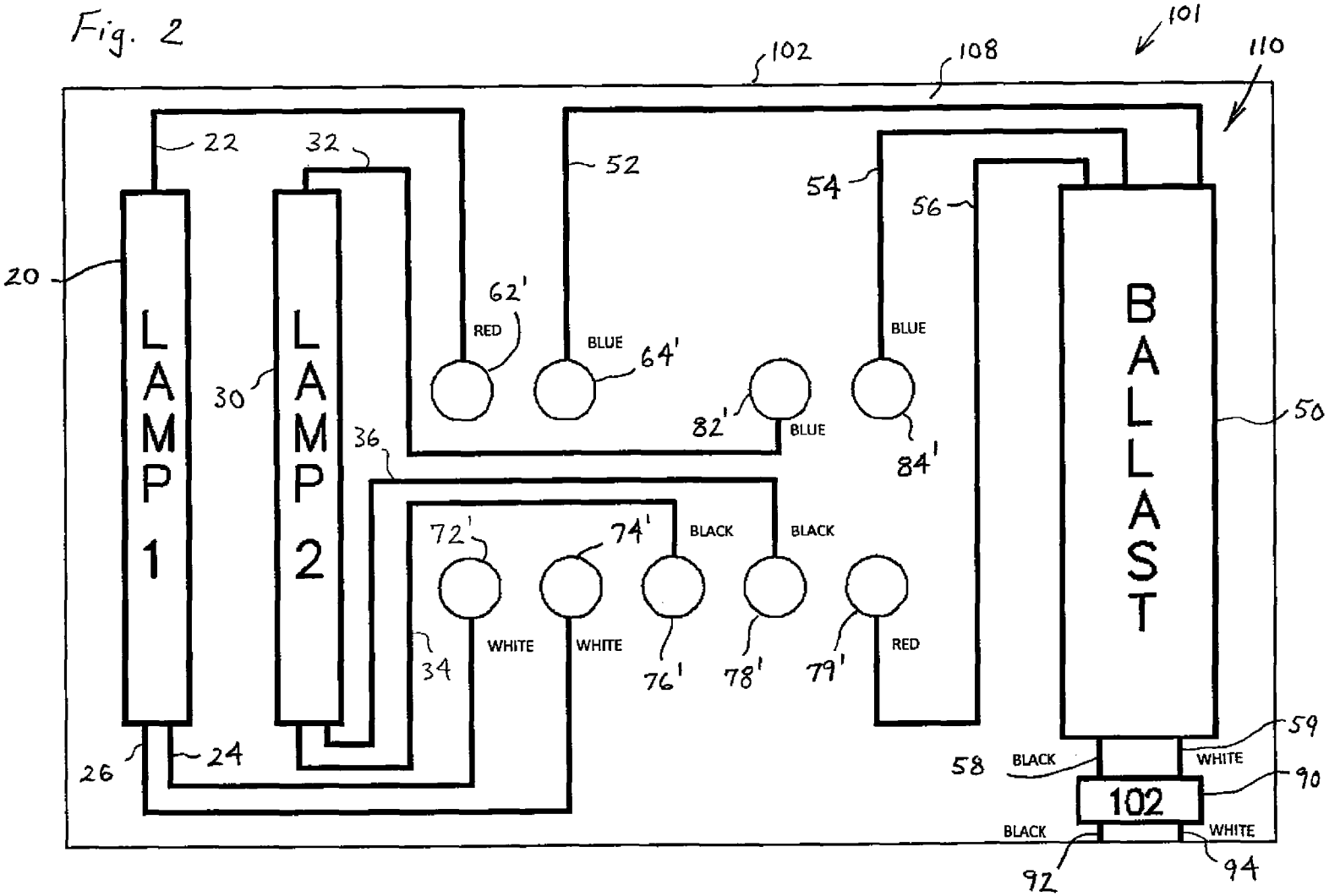
FIG. 2 is a wiring diagram for a circuit of a lighting system having an electronic ballast and two lamps.
Figure 3:
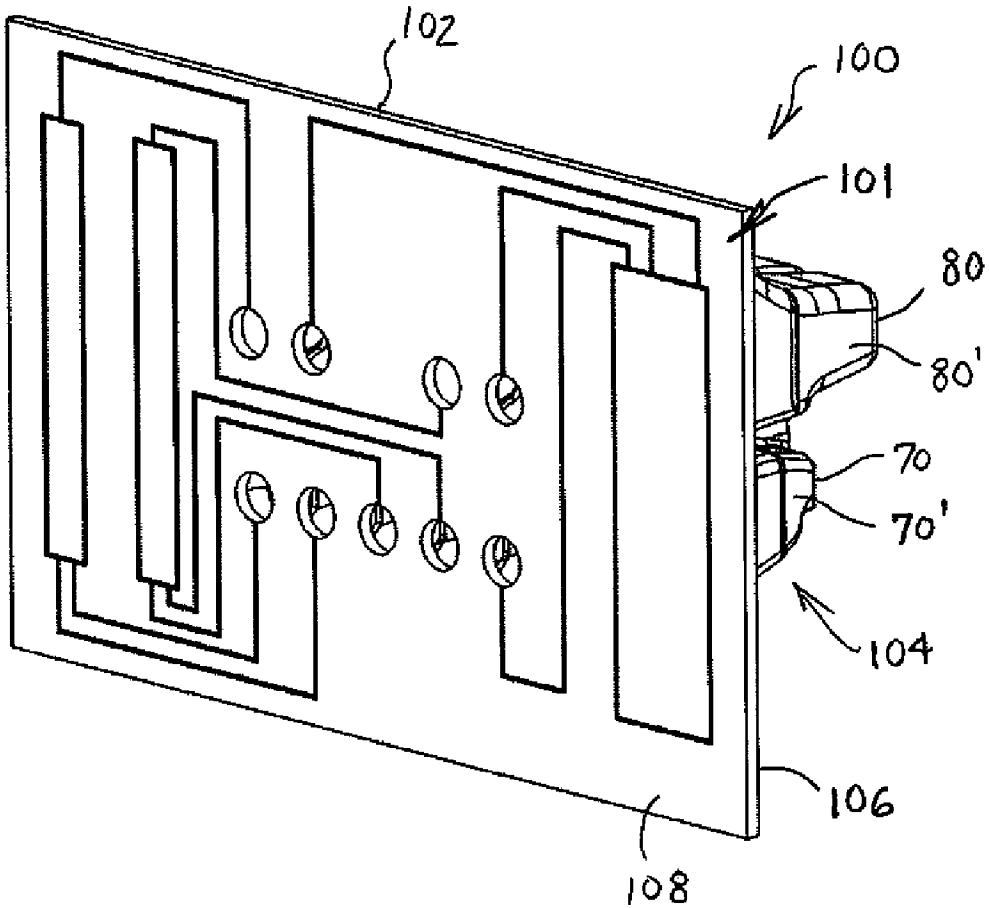
FIG. 3 is a front perspective view of a first example of a connector assembly with an integrated wiring diagram, where the wiring diagram has been somewhat simplified in this view but would be in accordance with the wiring diagram in FIG. 2.
Figure 4:
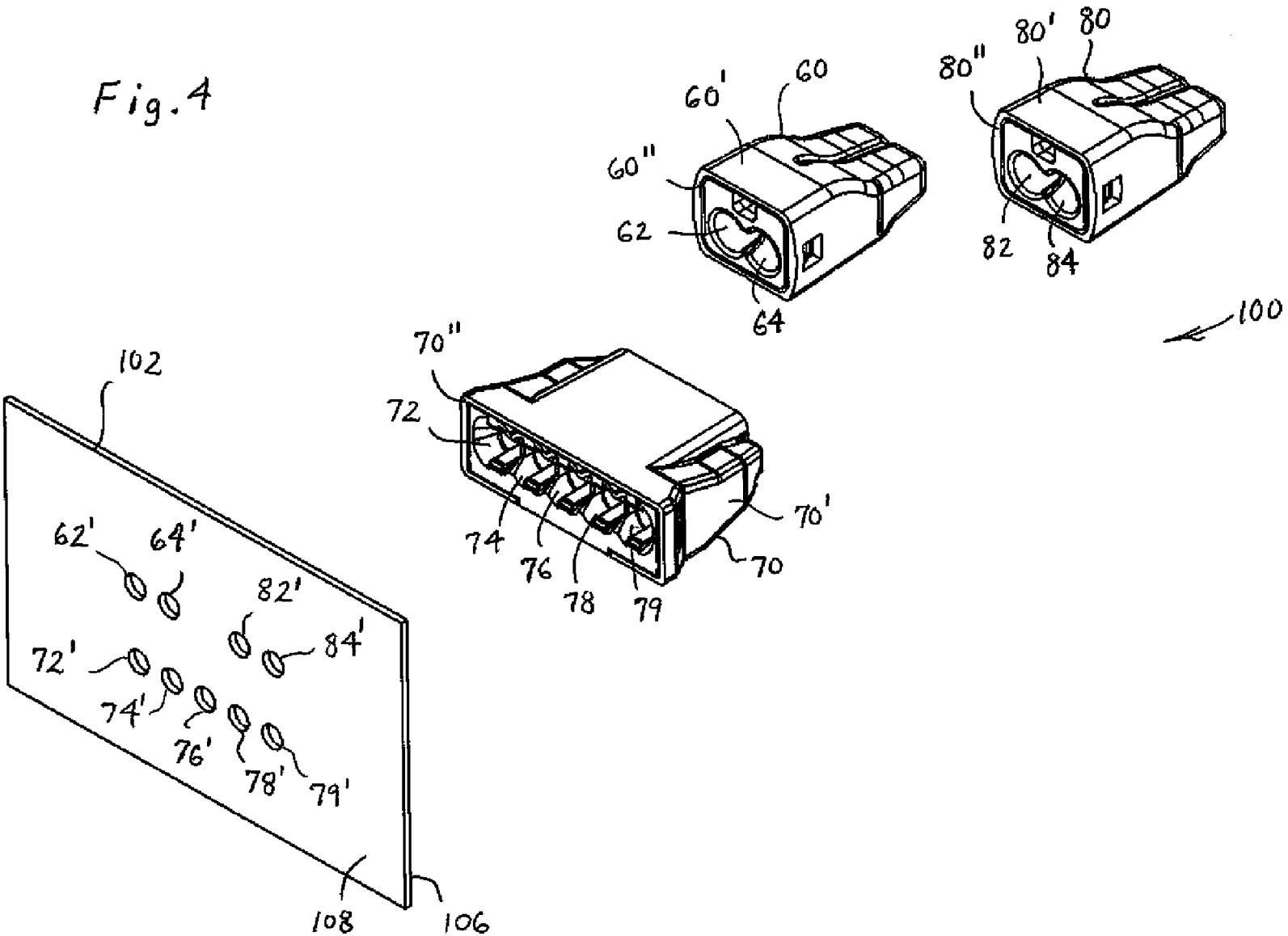
FIG. 4 is an exploded front perspective view of the connector assembly of FIG. 3 illustrating that it includes three housings connected to a front panel, where the front panel would include a wiring diagram in accordance with the wiring diagram in FIG. 2.
Figure 5:
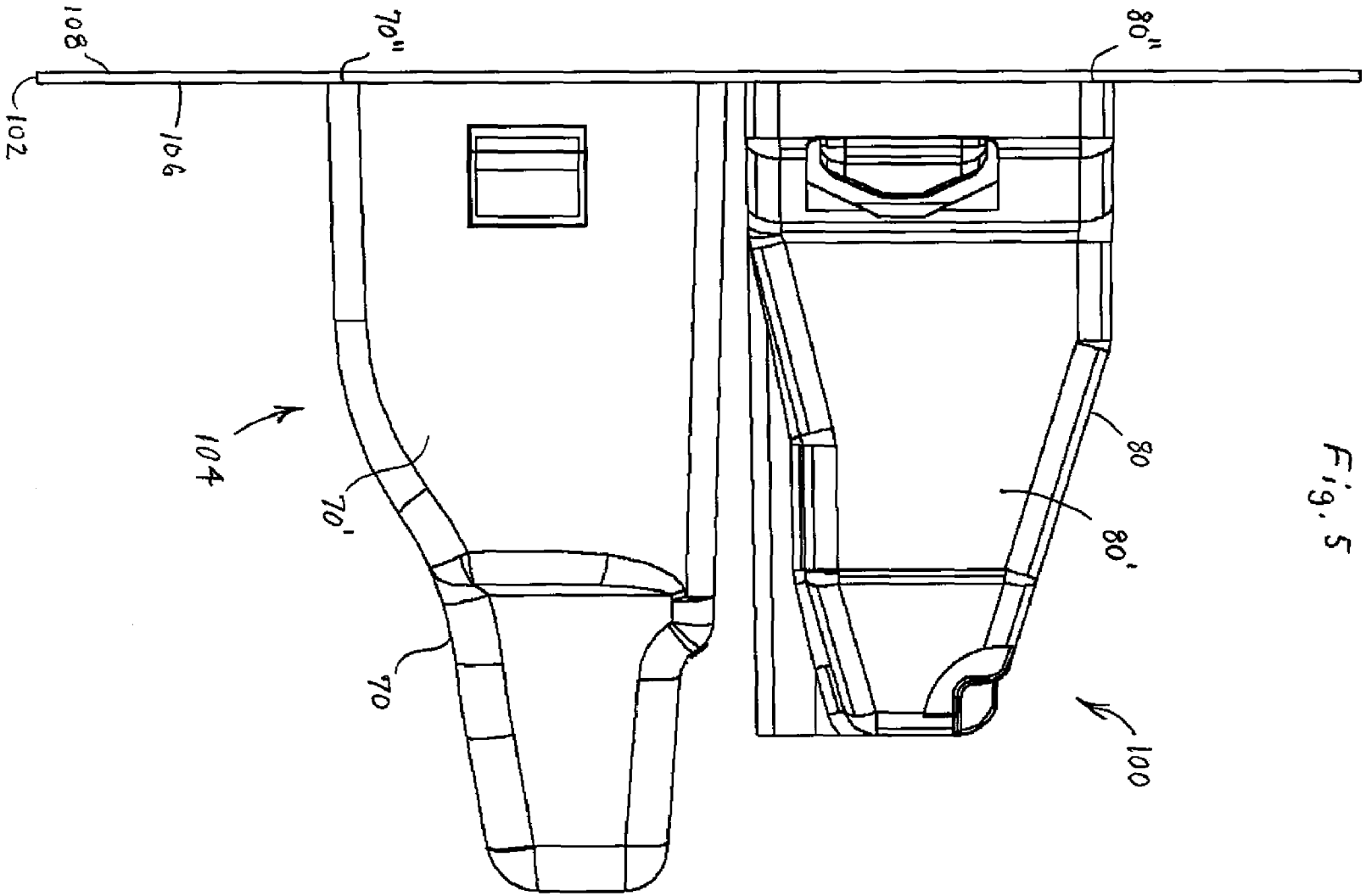
FIG. 5 is a side elevation view of the connector assembly and front panel of FIG. 4.

Now turning to the wiring diagram 101 shown in FIG. 2, the wiring diagram 101 may be provided on a front panel 102, such as by printing on a front surface 108 of a label bonded to or which forms the front panel 102, or by otherwise affixing or forming the wiring diagram into or onto a surface of the connector assembly. Thus, the wiring diagram could be printed, etched, engraved, molded or applied by other suitable techniques. While the present drawings include text to indicate colors of wire components, it will be appreciated that on an actual label the wire components may be depicted in their intended colors, with or without such additional text, or may be depicted as shown here in black and white but with the colors indicated by corresponding text.

The wiring diagram 101 on the front surface 108 of front panel 102 shows a lighting system 110 which is for an upgraded version of the lighting system 10 shown in FIG. 1. In FIG. 2, the wiring diagram 101 includes indicia for all of the components of the lighting system 110. The indicia indicate that the lighting system 110 includes within its major components the first lamp 20 and the second lamp 30, but the magnetic ballast 40 has been replaced by an electronic ballast 50. The wiring diagram 101 provides indicia for the lighting system 110 which still represents the red wire 22 extending from the first lamp 20, but the wiring diagram 101 now indicates that it extends to a first aperture 62' in the front panel 102 that happens to be associated with, i.e. aligned with, a first wire connector 60 (best seen in FIG. 4), with the first wire connector 60 having a first wire entry port 62 with which the first aperture 62' is associated. Thus, the user is effectively instructed to insert a stripped wire end of the red wire 22 through the first aperture 62' and into the first wire entry port 62 to secure an electrical connection with a contact within the first connector 60.

The remaining indicia representing the other wires within the wiring diagram 101 will now be described and they, in a similar manner, may be inserted through respective apertures and into respective wire connectors to secure electrical connection with respective conductive connecting elements or conductive contacts within the respective connectors. For instance, the first white wire 24 is represented by indicia showing that it extends from the first lamp 20, but the wiring diagram 101 now indicates that it extends to a first aperture 72' that happens to be associated with a second wire connector 70 (best seen in FIG. 4), with the second wire connector 70 having a first wire entry port 72 with which the first aperture 72' and a contact are associated. The second white wire 26 is represented by indicia showing that it extends from the first lamp 20, but instead of extending to a power supply, it is shown extending to a second aperture 74' that happens to be associated with the second wire connector 70, with the second wire connector 70 having a second wire entry port 74 with which the second aperture 74' and a contact are associated.

For the second lamp 30, the wiring diagram 101 provides indicia to represent that the lighting system 110 includes the blue wire 32 which extends from the second lamp 30, but the wiring diagram 101 now includes indicia to indicate that the blue wire 32 is to extend to a first aperture 82' that happens to be associated with a third wire connector 80 (best seen in FIG. 4), with the third wire connector 80 having a first wire entry port 82 with which the first aperture 82' and a contact are associated. The first black wire 34 is indicated as extending from the second lamp 30 to a third aperture 76' that happens to be associated with the second wire connector 70, with the second wire connector 70 having a third wire entry port 76 with which the third aperture 76' and a contact are associated. The second black wire 36 is indicated as extending from the second lamp 30 to a fourth aperture 78' that is not associated with a power supply, but rather happens to be associated with the second wire connector 70, with the second wire connector 70 having a fourth wire entry port 78 with which the fourth aperture 78' and a contact are associated.

The wiring diagram 101 further provides indicia to represent that the lighting system 110 also includes the electronic ballast 50 and a first blue wire 52 which extends to a second aperture 64' that happens to be associated with the first wire connector 60, with the first wire connector 60 having a second wire entry port 64 with which the second aperture 64' and a contact are associated. A second blue wire 54 is indicated as extending from the electronic ballast 50 to a second aperture 84' that happens to be associated with the third wire connector 80, with the third wire connector 80 having a second wire entry port 84 with which the second aperture 84' and a contact are associated. The wiring diagram 101 further includes indicia representing that the electronic ballast 50 has a red wire 56 which extends to a fifth aperture 79' that happens to be associated with the second wire connector 70, with the second wire connector 70 having a fifth wire entry port 79 with which the fifth aperture 79' and a contact are associated. Note that it will be appreciated that with any of the example labels within this disclosure, it may be possible to identify, such as by use of a circle, designated areas through which to puncture the label when inserting a wire, as opposed to providing an aperture. Also, if the wiring diagram is provided without use of a label or other sheet material, such as may be achieved by printing on, etching into or molding the indicia into the connector assembly, the insertion areas would not have a sheet material to be removed or punctured.

The electronic ballast 50 also is represented as having a black wire 58 and a white wire 59 extending to a disconnect 90, such as a Model 102 disconnect sold by IDEAL Industries, Inc. The indicia on the wiring diagram 101 further indicates that the disconnect 90, in turn, has a respective black wire 92 and white wire 94 extending from it and which would be connected to a power supply.

The wiring diagram 101 is somewhat simplified and is an example for illustration purposes only and it will be appreciated, for instance, that the color of the particular wires could be different, the number and orientation of the apertures, components and wire indicia all could be different, and the ground is not shown. Nevertheless, a comparison between the wiring diagrams 1 and 101 indicates that the process of rewiring for replacement of the magnetic ballast 40 with the electronic ballast 50 does not merely require splicing in a replacement component on a one-for-one basis. Indeed the counter-intuitive nature of this particular rewiring effort provides an excellent example of how this connector assembly with integrated wiring diagram 100 would improve the convenience and safety that might otherwise be compromised if an electrician or other user were forced to try to design or discern the necessary changes in the wiring of the circuit.

Figure 6:
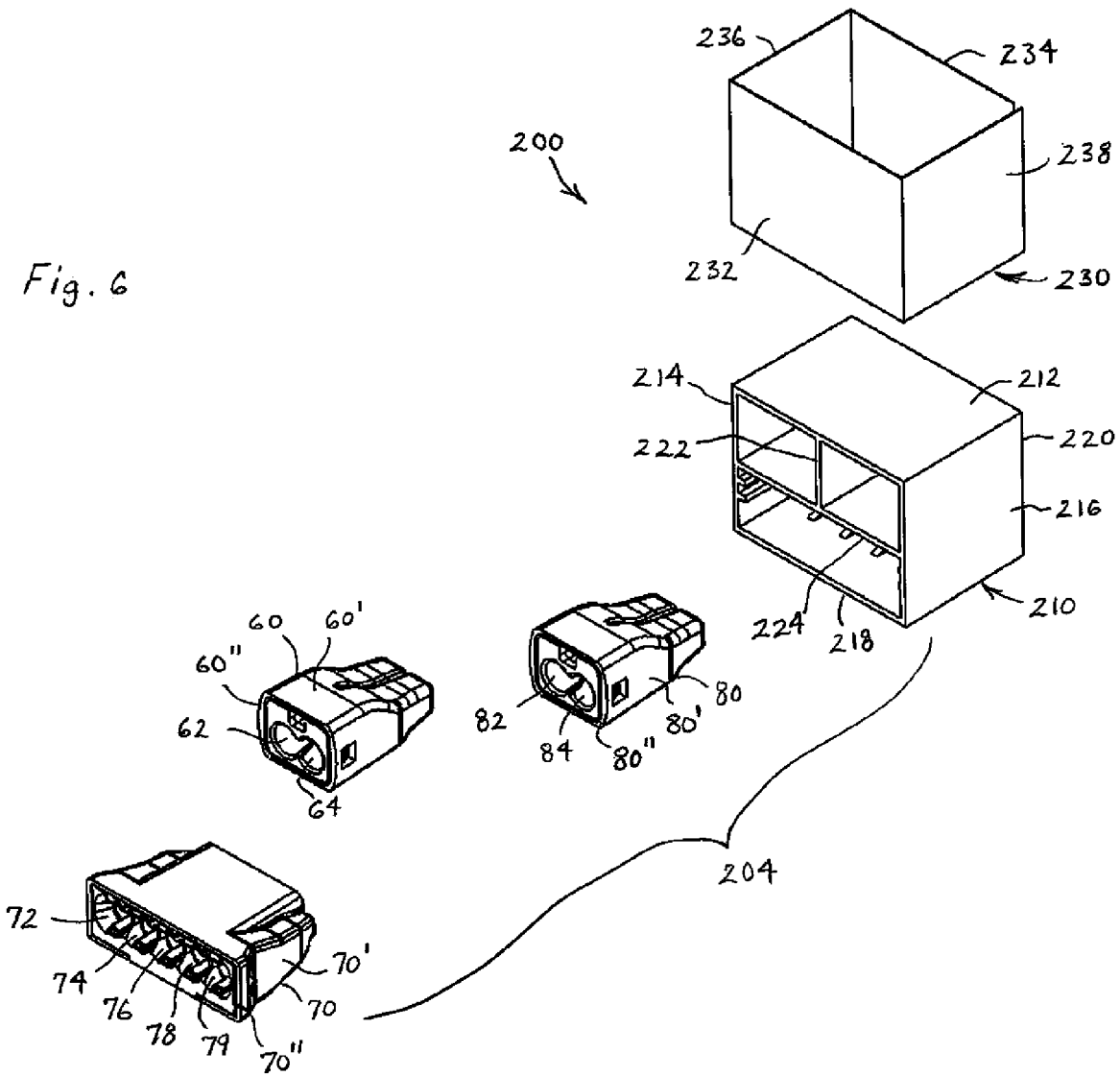
FIG. 6 is an exploded front perspective view of another example of a connector assembly with an integrated wiring diagram, where the connector assembly includes a plurality of housings received within a receptacle and the wiring diagram is shown in a simplified illustration of a label.
Figure 7:
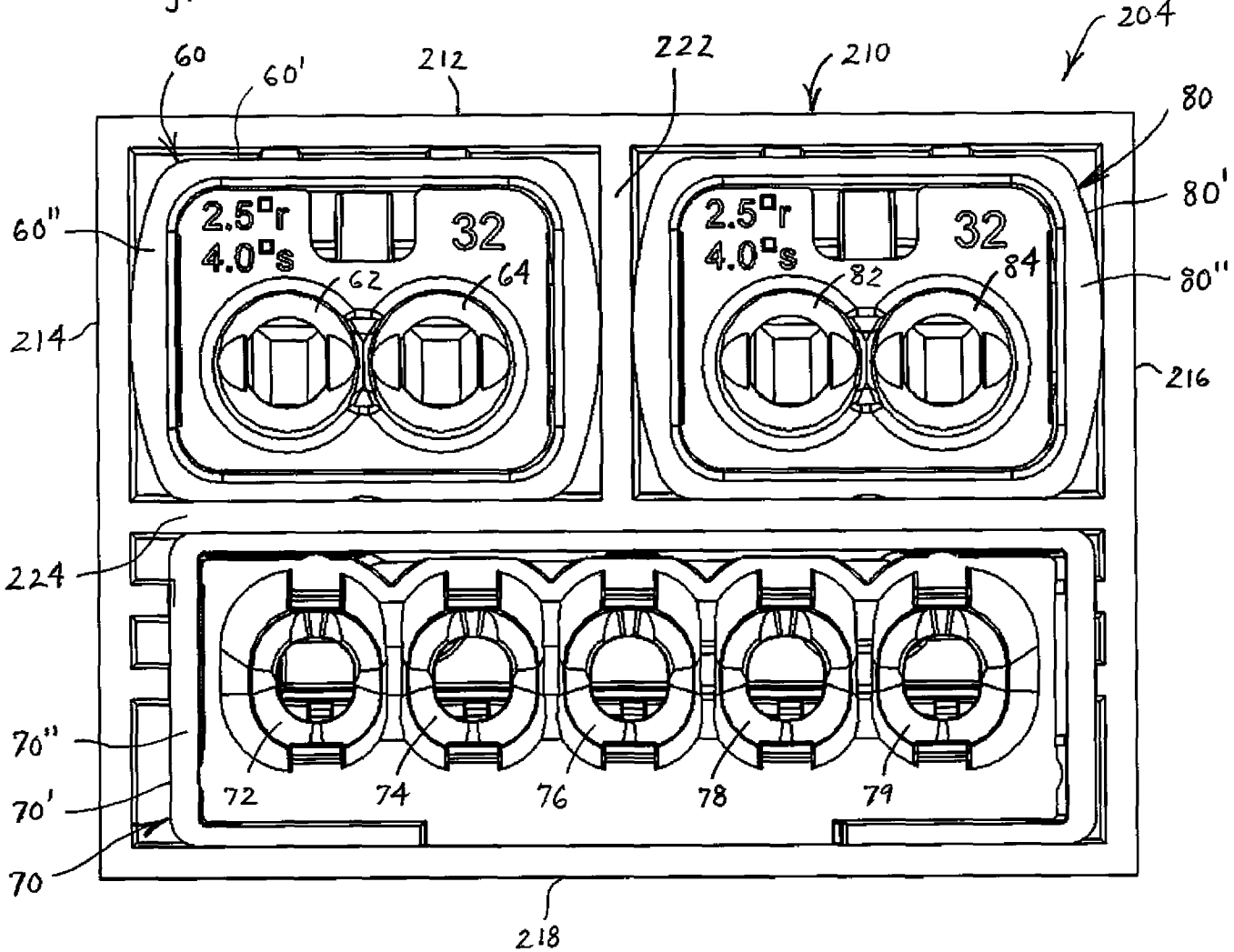
FIG. 7 is a front view of the embodiment of FIG. 6 showing the plurality of wire connector housings located within the receptacle shown in FIG. 6.
Figure 8:
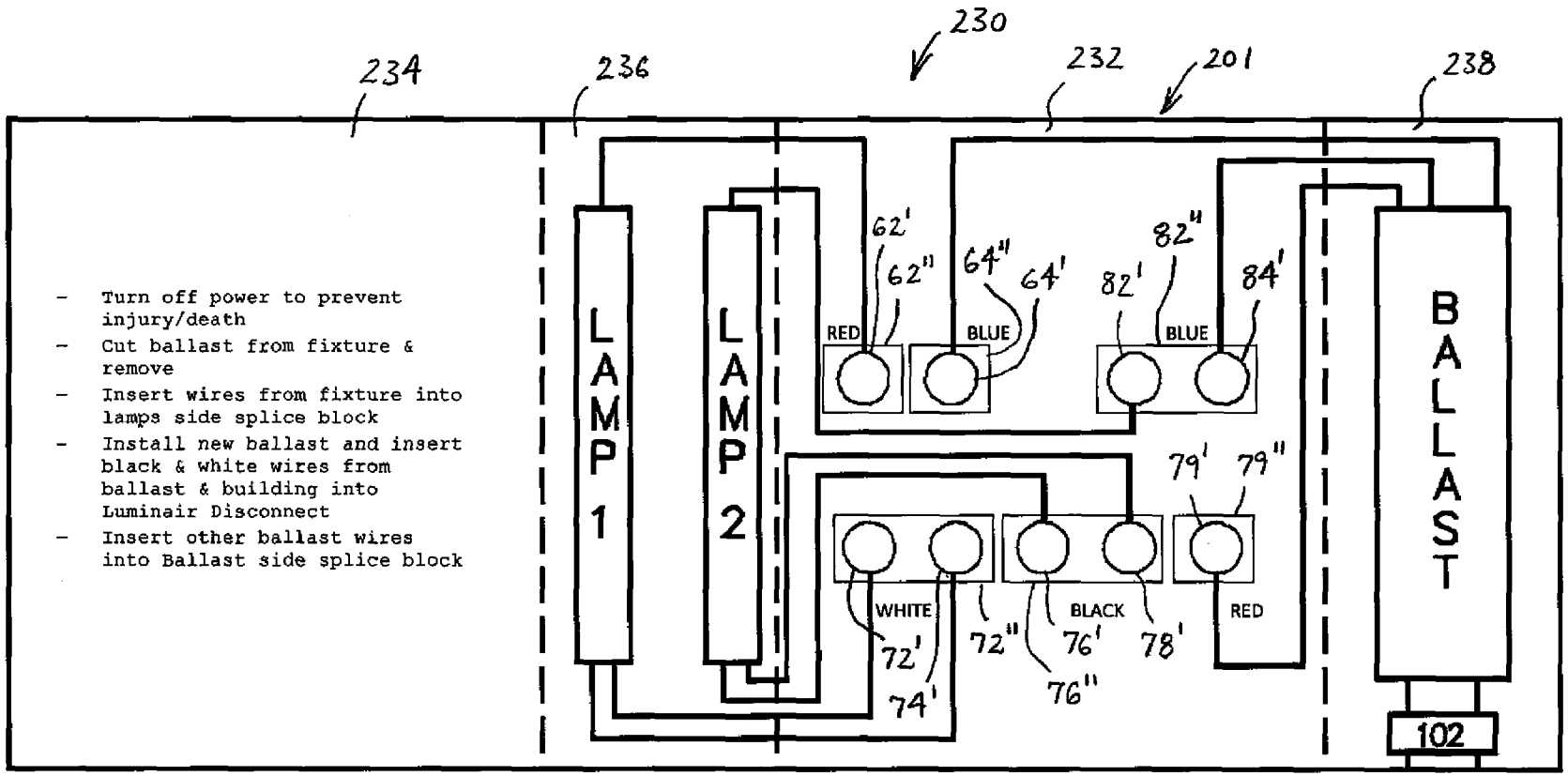
FIG. 8 is a front view of the label from FIG. 6 with a more detailed illustration of the content on the label.

While FIGS. 2-5 disclose and illustrate one example of a connector assembly with an integrated wiring diagram 100, another example is illustrated in FIGS. 6-8. To focus on the differences, this example will use the same relatively standard two-port push-in wire connectors 60 and 80, and five-port push-in wire connector 70, all of which are sold by IDEAL Industries, Inc. and have respective housings 60', 70' and 80'. However, in this example, a connector assembly with an integrated wiring diagram 200 is formed in a different manner.

A connector assembly 204 is formed by the three wire connectors 60, 70 and 80 that are loaded into a receptacle 210. The receptacle 210 includes a top wall 212, two opposed side walls 214, 216, a bottom wall 218, a rear wall 220, an internal vertical wall 222 and an internal horizontal wall 224. The walls of the receptacle 210 assist in positively locating the respective housings 60', 70' and 80' of connectors 60, 70 and 80, and may include complementary engagement surfaces configured to assist in retaining the connectors in the receptacle 210, such as snap fit protrusions or recesses, or may include other suitable fastening means. Alternatively, the receptacle 210 may not include any additional engagement features for retaining the connectors located therein, but instead may achieve containment based, for instance, on an overlying front panel, such as is provided in this embodiment as part of an elongated label 230.

In FIGS. 6 and 8, a label 230 includes a front panel 232, a rear panel 234 and two opposed side panels 236, 238. The label 230 may be of suitable construction to hold the connectors 60, 70 and 80 within the receptacle 210, such as by being constructed of a paper and/or plastic sheet material and having adhesive on a rear surface 240 that may contact the respective front faces 60", 70" and/or 80", or being heat sealed or shrink wrapped to the receptacle 210. The label 230 may include a printable surface or laminate including one or more layers bearing indicia for one or more designated circuits. The label 230 is shown in FIG. 6 in a very simplified manner to show the panels, without any indicia or apertures. However, the label 230 also is shown in FIG. 8 in a flattened state, prior to installation, with the necessary indicia and apertures, and dashed fold lines. The label 230 in FIG. 8 displays indicia in a somewhat different manner than the indicia shown on the front surface 108 of the label 102 of the prior embodiment. For instance, the label 230 takes advantage of the fact that it may be wrapped around planar surfaces of the receptacle 210, and therefore, includes some of its wiring diagram 201 on the front panel 232, where the apertures are located, while displaying additional indicia for the circuit on the two opposed side panels 236, 238. The further area provided by the rear panel 234 permits further space to communicate information, such as instructions relating to the replacement procedure including the removal of one component and the rewiring to accommodate the newly added component.

For purposes of this disclosure, FIG. 8 includes text to indicate colors that are intended to be used on the label 230, such as the colors of the rectangular areas provided on the label 230 that surround the apertures through the label 230. For instance, in relation to the first wire connector 60, a red rectangular area 62" surrounds an aperture 62', while a blue rectangular area 64" surrounds an aperture 64'. In relation to the second wire connector 70, a white rectangular area 72" surrounds apertures 72' and 74', a black rectangular area 76" surrounds apertures 76' and 78', and a red rectangular area 79" surrounds an aperture 79'. In turn, in relation to the third wire connector 80, a blue rectangular area 82" surrounds apertures 82' and 84'. It will be appreciated that the wire connectors 60, 70 and 80 include the same respective wire entry ports 62, 64, 72, 74, 76, 78, 79, 82 and 84, and associated conductive connecting elements or conductive contacts, as described in the previous embodiment. It also will be appreciated that the label 230 may include the actual colors of the rectangular areas and of the wire elements and/or may be labeled with text as desired.

Figure 9:
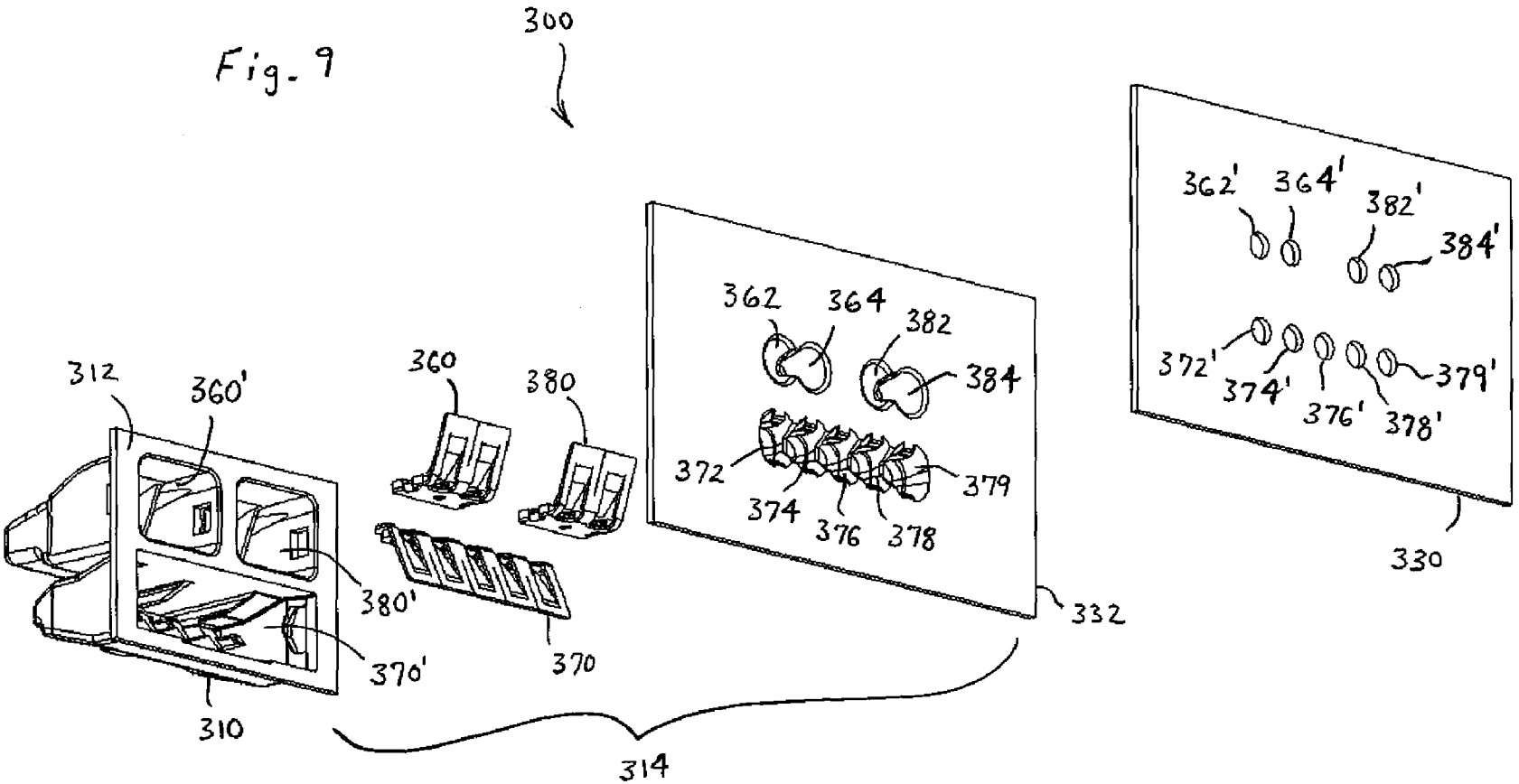
FIG. 9 is an exploded front perspective view of a further example of a connector assembly with an integrated wiring diagram, where the connector assembly includes one housing and a front panel having a wiring diagram on a label which has been shown in simplified form but would include a wiring diagram in accordance with FIG. 2 for this embodiment.

Turning to FIG. 9, a further embodiment of a connector assembly with an integrated wiring diagram 300 is shown. In this embodiment, the conductive connecting elements or conductive contacts of the prior embodiments are no longer contained within three separate wire connectors. Instead, in this example a single housing 310 holds respective conductive connector elements 360, 370 and 380. The housing 310 includes a face frame 312 and separate respective formed cavities 360', 370' and 380' extending rearward from the face frame 312 to hold the respective conductive connector elements 360, 370 and 380. A relatively rigid corresponding front panel 332 having appropriate wire entry ports 362, 364, 372, 374, 376, 378, 379, 382 and 384 is attached to the face frame 312 of the housing by suitable attaching means, such as adhesive or heat bonding the face frame 312 to the front panel 332 to close and complete the connector assembly 314.

A label 330 is shown in a simplified manner in FIG. 9, and it will be understood that it may include indicia to represent the electronic components and wire elements consistent with the label 102 in FIG. 2, or label 230 in FIG. 8. Thus, it includes respective apertures 362', 364', 372', 374', 376', 378', 379', 382' and 384'. However, as noted above, it will be appreciated that with any of the labels 102, 230 or 330, it may be possible to show designated areas through which to puncture the label, as opposed to providing an aperture for wire insertion, or the indicia may be applied without a label.

Figure 10:
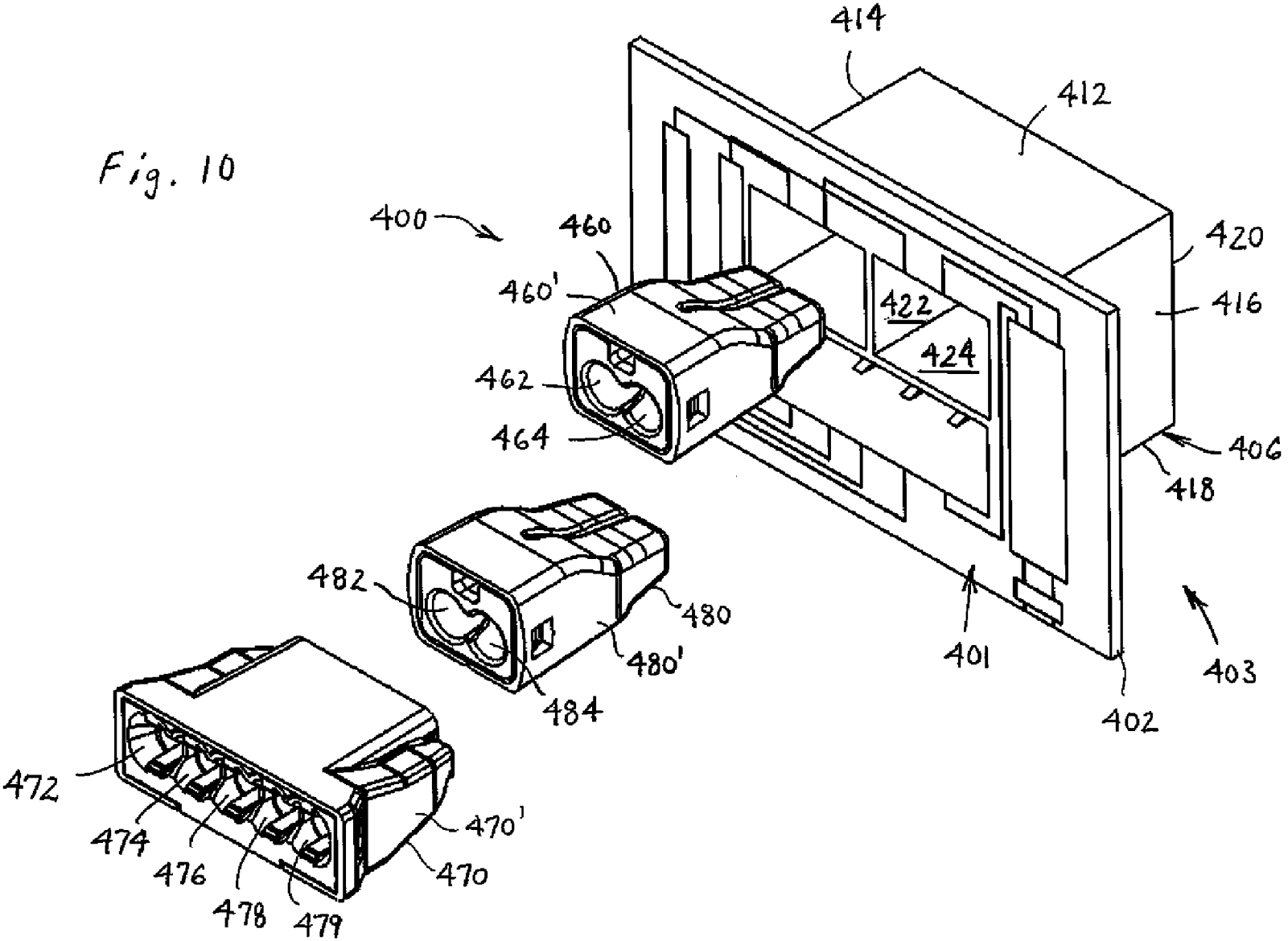
FIG. 10 is an exploded front perspective view of another example having a connector assembly with an integrated wiring diagram, where the connector assembly is temporarily received in a receptacle of a tool and the tool includes a wiring diagram which corresponds to the connector assembly and which is shown in a simplified illustration.
Figure 11:
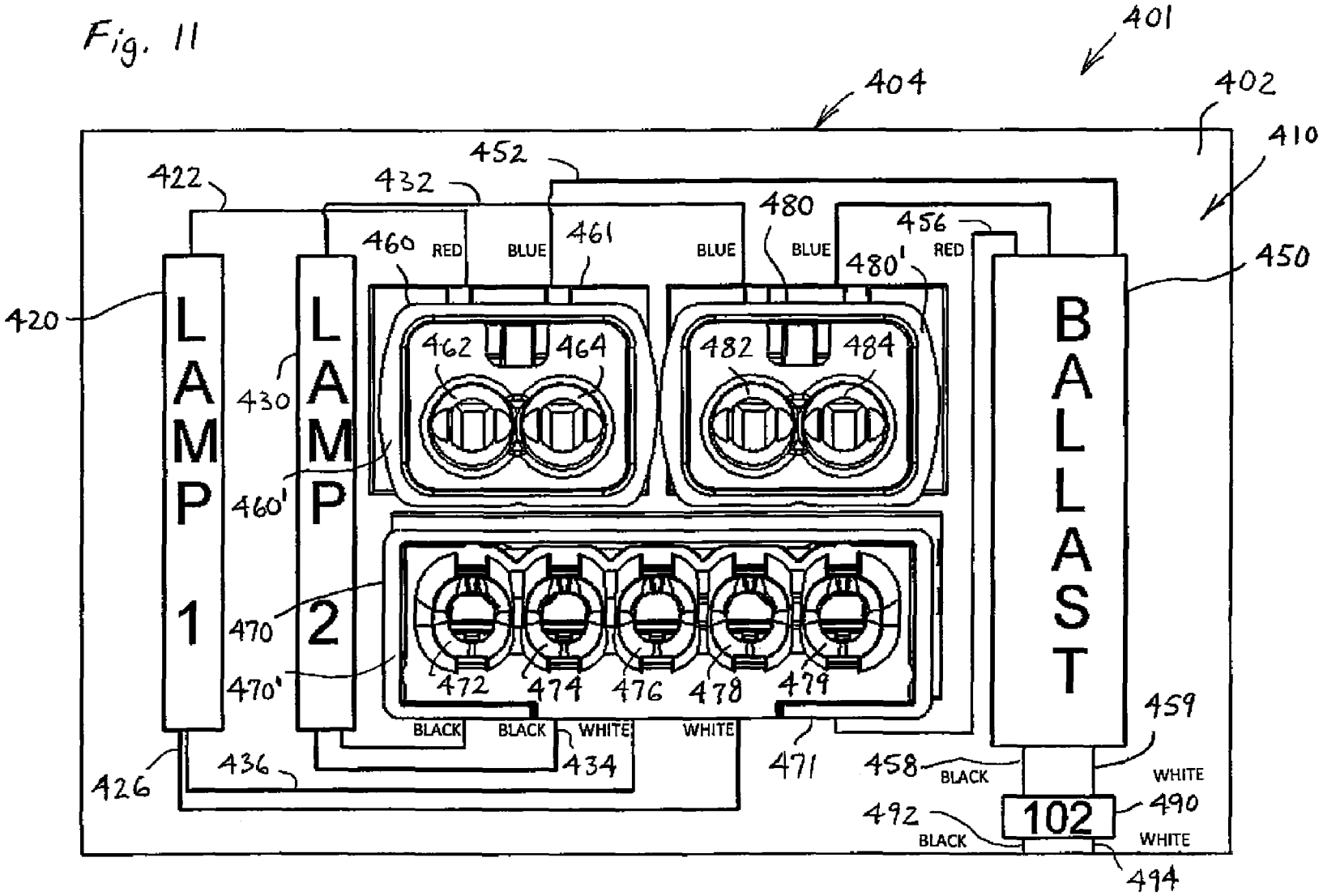
FIG. 11 is a wiring diagram for the rewiring of the circuit shown in FIG. 1 when replacing the magnetic ballast with an electronic ballast and for use on a tool such as is shown in FIG. 9 where the connector assembly is permitted to pass through one or more apertures in the diagram.

Turning to FIGS. 10 and 11, another embodiment of a connector assembly with an integrated wiring diagram 400 is shown, although this embodiment is configured for temporary construction of the connector assembly with an integrated wiring diagram 400. Namely, this embodiment includes an integrated wiring diagram 401 located on a front panel 402 of a tool 403 which is used to temporarily hold wire connectors 460, 470 and 480, which are similar to wire connectors 60, 70 and 80. Thus, during installation of the wires and components within the circuit, the tool 403 is used to temporarily form a connector assembly 404, and given the indicia on its front panel 402, there is formed a connector assembly with an integrated wiring diagram 400.

In this example, the tool 403 includes a receptacle 406 configured to temporarily receive the wire connectors 460, 470 and 480. The receptacle 406 is formed by a top wall 412, two opposed side walls 414, 416 and a bottom wall 418, all of which extend rearward from the front panel 402, and which are joined in a rear wall 420. The receptacle 406 further includes an internal vertical wall 422 and an internal horizontal wall 424. The walls of the receptacle 406 assist in positively locating the respective housings 460', 470' and 480' of connectors 460, 470 and 480, and are intended to hold the connectors via gravity when the tool 403 is in an upright or inclined position with the front panel 402 above the rear panel 420. Thus, the connectors 460, 470 and 480 may be loaded into their respective areas within the receptacle 406 and upon completion of inserting the appropriate conductive ends of wires within the wire connectors to engage the respective conductive connecting elements or conductive contacts of the connectors, such that there is a temporary forming of the connector assembly 404, and then the tool 403 may be moved away, inverted or the wire connectors may be lifted from the receptacle 406 by gently pulling on the respective wires. In this configuration, the wiring diagram 401 is in a relatively planar orientation with the face of the respective housings 460', 470' and 480' of the connectors 460, 470 and 480 when they are within the receptacle 406. It will be appreciated that the receptacle 406 may include engagement surfaces configured to assist in retaining the connectors in the receptacle 406 and may include apertures or mechanisms in the rear wall 420, top wall 412, side walls 414, 416, and/or bottom wall 418 to permit a user to push or eject the wire connectors from the receptacle 406. Such apertures also may permit access to further wire entry ports in other sides of the wire connectors, with the receptacle including slots to allow the wire connector assembly with inserted wires to then be removed from the receptacle.

In the example in FIGS. 10 and 11, given that the wire connectors 460, 470 and 480 must be removed from the tool 403, a different label 430 is used on the front panel 402 of the tool 403. In particular, the label 430 must include one or more apertures through which the connectors in their entirety may pass when being removed from the receptacle 406. Thus, it may be one aperture that circumscribes the wire connectors for the location of the faces of the wire connectors or may have apertures, such as 461, 471 and 481, with small segments therebetween which overlap the edge of the internal walls, such as the internal vertical wall 422 and the internal horizontal wall 424. With such larger apertures, the indicia on the label 430 corresponds with the positions of the respective wire entry ports of the wire connector housings, as opposed to ending at individual wire entry ports. This is shown, for example in FIGS. 10 and 11, where, as with the prior examples, the wire colors are noted with text that would be optional if the label 430 were provided in color. The wiring diagram 401 essentially conveys similar information to that shown in FIG. 2 or in the front and side panels shown in FIG. 8, except that the user can see the wire connectors into which the respective wires are to be inserted to engage respective conductive connecting elements or conductive contacts, and the positions on the wire connector 480 for the white and black wires happen to have been reversed.

Thus, In FIG. 11, the wiring diagram 401 includes indicia for all of the components of the lighting system 410. The indicia indicate that the lighting system 410 includes within its major components the first lamp 420 and the second lamp 430, and but an electronic ballast 450. The wiring diagram 401 provides indicia for the lighting system 410 which represents a red wire 422 extending from the first lamp 420 to the aperture 461 in the front panel 402 and being in alignment with a first wire entry port 462 of the first wire connector 460. A first white wire 424 is represented by indicia showing that it extends from the first lamp 420 to the aperture 470' in front panel 402 and is in alignment with a third wire entry port 476 of the second wire connector 470. A second white wire 426 is represented by indicia showing that it extends from the first lamp 420 to the aperture 471 and is in alignment a fourth wire entry port 478 of the second wire connector 470.

For the second lamp 430, the wiring diagram 401 provides indicia to represent that the lighting system 410 includes a blue wire 432 which extends from the second lamp 430 to the aperture 481 in the front panel 402 and is in alignment with a first wire entry port 482 of the third wire connector 480. A first black wire 434 is indicated as extending from the second lamp 430 to the aperture 471 and is in alignment with a second wire entry port 474 of the second wire connector 470. A second black wire 436 is indicated as extending from the second lamp 430 to the aperture 471 and is in alignment with a first wire entry port 472 of the second wire connector 470.

The wiring diagram 401 further provides indicia to represent that the lighting system 410 also includes the electronic ballast 450 and a first blue wire 452 which extends to the aperture 461 and is in alignment with a second wire entry port 464 of the first wire connector 460. A second blue wire 454 is indicated as extending from the electronic ballast 450 to the aperture 481 and is in alignment with a second wire entry port 484 of the third wire connector 480. The wiring diagram 401 further includes indicia representing that the electronic ballast 450 has a red wire 456 which extends to the aperture 471 and is in alignment with a fifth wire entry port 479 of the second wire connector 470. It will be appreciated that if the wiring diagram is provided without use of a label or other sheet material, such as may be achieved by printing on, etching into or molding the indicia into the connector assembly, the apertures would not be surrounded by such label or sheet material.

The electronic ballast 450 also is represented as having a black wire 458 and a white wire 459 extending to a disconnect 490, such as a Model 102 disconnect sold by IDEAL Industries, Inc. The indicia on the wiring diagram 401 further indicates that the disconnect 490, in turn, has a respective black wire 492 and white wire 494 extending from it and which would be connected to a power supply. As with the prior wiring diagrams, the wiring diagram 401 is somewhat simplified and is an example for illustration purposes only and it will be appreciated, for instance, that the color of the particular wires could be different, the number and orientation of the apertures, components and wire indicia all could be different, and the ground is not shown.

Figure 12:
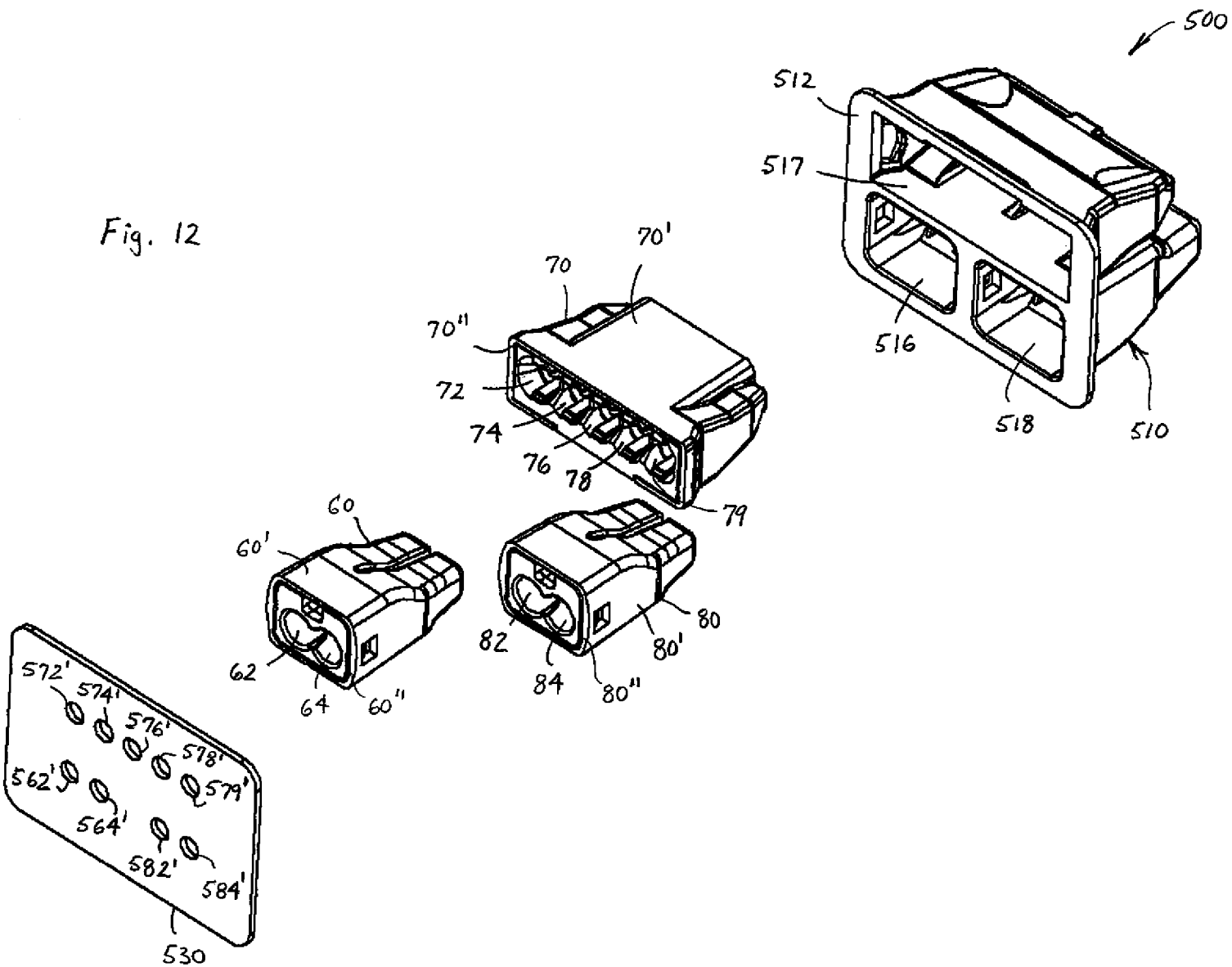
FIG. 12 is an exploded front perspective view of a further example having a connector assembly with an integrated wiring diagram, where the connection assembly includes a plurality of housings received within a receptacle and the wiring diagram is shown in a simplified illustration of a label.

Turning to FIG. 12, a further example of a connector assembly with an integrated wiring diagram 500 is shown. This embodiment combines the concepts shown in the examples illustrated in FIGS. 6 and 9. A formed receptacle 510 is configured to hold connectors 60, 70 and 80 and a label 530 is applied to the connector assembly covering the faces 60", 70" and 80" of the connectors. The walls of the receptacle 510 assist in positively locating the respective housings 60', 70' and 80' of the connectors 60, 70 and 80, and may include complementary engagement surfaces configured to assist in retaining the connectors in the receptacle 510, such as snap fit protrusions or recesses, or may include other suitable fastening means.

The label 530 is shown in a simplified manner in FIG. 12, but it will be understood that it may include indicia to represent the electronic components and wire elements consistent with the label 102 in FIG. 2, or label 230 in FIG. 8. In this example, the label 530 is applied to a face frame 512 of the receptacle 510 that surrounds formed cavities 516, 517 and 518 that receive the connectors 60, 70 and 80, respectively. It will be understood that the wiring diagram indicia on the label 530 may include apertures 562', 564', 572', 574', 576', 578', 579', 582' and 584' that correspond to and are to be aligned with wire entry ports 562, 564, 572, 574, 576, 578, 579, 582 and 584, respectively. Thus, as noted above, it will be appreciated that the label 530 may show designated areas through which to puncture the label, as opposed to actually providing an aperture for wire insertion. Also, the label 530 may be constructed of any suitable material to present the indicia and may be connected to the connector assembly 500 by use of any one of numerous methods, such as have been described with respect to the preceding examples.

It will be appreciated that a connector assembly having an integrated wiring diagram 100, 200, 300, 400 and/or 500 can be manufactured in accordance with the above disclosure by providing a connector assembly having a plurality of wire entry ports, providing a label that includes at least a portion of a wiring diagram having wire indicia displayed in association with the intended location of the respective wire entry ports of the connector assembly, and attaching the label to the connector assembly wherein the wire indicia is located in association with the respective wire entry ports of the connector assembly. Consistent with the above disclosure, providing a connector assembly may include providing at least one wire connector having a plurality of wire entry ports. As with the examples in FIGS. 6-8 and 12, the connector assembly may include a receptacle that stays with the wire connectors or, as in FIGS. 10-11, a receptacle that is used to temporarily form and hold a connector assembly. Also, the label may be constructed of any suitable materials and may be applied in numerous suitable ways, including at least those set forth above in this disclosure. Certainly, as further noted within this disclosure, a connector assembly having an integrated wiring diagram also may be manufactured without use of a label, but rather may apply the indicia for a wiring diagram on the connector assembly via various suitable ways of adding graphics and/or text to such connector assemblies.

While preferred forms have been provided in this disclosure, these examples are merely illustrative and are not limiting of the claims. It will be appreciated that there may be many modifications, substitutions and alterations that may be made to the structures and methods discussed without departing from the scope or spirit of the present disclosure. Thus, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

I claim:

1. A connector assembly having an integrated wiring diagram comprising:

a connector assembly having at least one housing having walls extending rearward from a face, wherein the face includes a plurality of wire entry ports;

a wiring diagram located on the outer surface of the face of the connector assembly that has the plurality of wire entry ports, the wiring diagram having wire indicia depicting wires and electrical or electronic components that are external to the connector assembly displayed in association with the respective plurality of wire entry ports through the face of the connector assembly;

wherein each wire entry port is configured to receive a conductive stripped end of at least one inserted wire; and wherein a plurality of conductive contacts are held within the housing, and each of the conductive contacts is configured to receive and electrically connect at least two different respective conductive stripped ends of wires that are inserted through separate respective wire entry ports in the face of the connector assembly that includes the wiring diagram on its outer surface.

2. The connector assembly having an integrated wiring diagram of claim 1 wherein the wiring diagram is applied to the connector assembly in the form of a label.

3. The connector assembly having an integrated wiring diagram of claim 1 wherein the wiring diagram is applied to the connector assembly by printing on the connector assembly.

4. The connector assembly having an integrated wiring diagram of claim 1 wherein the wiring diagram is displayed on the connector assembly by forming the diagram on an outer surface of the connector assembly.

5. The connector assembly having an integrated wiring diagram of claim 1 further comprising a plurality of housings, with each housing having at least one face having a plurality of wire entry ports.

6. The connector assembly having an integrated wiring diagram of claim 5 wherein the connector assembly further comprises a receptacle that receives the plurality of housings.

7. The connector assembly having an integrated wiring diagram of claim 1 wherein the wiring diagram is applied to the connector assembly in the form of a label having at least one aperture.

8. The connector assembly having an integrated wiring diagram of claim 7 wherein the label includes a plurality of apertures and only one wire entry port of the connector assembly is associated with each respective aperture.

9. The connector assembly having an integrated wiring diagram of claim 1 wherein each conductive contact is configured and positioned to be aligned with at least two of the respective plurality of wire entry ports.

10. A tool for use with a connector assembly and having an integrated wiring diagram, the tool comprising:

a front panel;

a receptacle including walls extending rearward from the front panel, with the receptacle configured to temporarily receive a connector assembly, wherein the connector assembly further comprises at least one wire connector housing, with the at least one wire connector housing having at least one face and a plurality of wire entry ports in the at least one face;

a wiring diagram located on the front panel and being disposed adjacent the receptacle and having wire indicia depicting wires and electrical or electronic components located in correspondence to positions of the respective plurality of wire entry ports of the at least one wire connector housing;

wherein the tool is configured to allow wires to be inserted into a connector assembly that is temporarily received in the receptacle of the tool and to allow a connector assembly having inserted wires to be removed from the receptacle, wherein the connector assembly and wires are completely separated from the tool.

11. The tool of claim 10 wherein the connector assembly further comprises a plurality of wire connector housings, with each wire connector housing having at least one face and a plurality of wire entry ports in the at least one face.

12. A label for in combination with a connector assembly comprising:

a connector assembly having at least one housing having walls extending rearward from a face, wherein the connector assembly includes a plurality of wire entry ports; wherein each wire entry port is configured to receive a conductive stripped end of at least one inserted wire;

wherein a plurality of conductive contacts are held within the housing, and each of the conductive contacts is configured to receive and electrically connect at least two different respective conductive stripped ends of wires that are inserted through separate respective wire entry ports in the face of the connector assembly;

a label having a front panel including at least a portion of a wiring diagram having wire indicia depicting wires and electrical or electronic components that are external to the connector assembly displayed on the front surface of the front panel and the wire indicia being associated with respective wire entry ports of a the connector assembly, the front surface being opposite a rear surface of the front panel which is to be disposed in a planar orientation with respect to a front the face of the connector assembly, the label being constructed for fixed attachment to the connector assembly and the label having at least one aperture associated with the wire indicia and through which conductive ends of wires may be inserted.

13. The label of claim 12 further comprising adhesive on the rear surface of the front panel for connection to the front of the connector assembly.

14. The label of claim 12 wherein the label is configured for connection to a connector assembly comprising at least one connector housing.

15. The label of claim 12 wherein the label is configured for connection to a connector assembly comprising a plurality of connector housings.

16. The label of claim 15 wherein the label is configured for connection to a connector assembly further comprising a receptacle configured to receive the plurality of connector housings.

17. The label of claim 12 further comprising a thermal formable sheet configured to be connected to the connector assembly by heat shrinking the sheet to at least partially cover the side portions of the connector assembly.

18. The label of claim 12 wherein the label includes a wiring diagram for a plurality of electrical devices on the front surface of the front panel.

* * * * *